United States Patent [19]

Pankowiecki

[11] Patent Number: 4,838,953

[45] Date of Patent: Jun. 13, 1989

[54] ADJUSTABLE OIL EJECTOR

[75] Inventor: Joseph Pankowiecki, Casselberry, Fla.

[73] Assignee: Westinghouse Electric Corp., Pittsburgh, Pa.

[21] Appl. No.: 209,715

[22] Filed: Jun. 22, 1988

[51] Int. Cl.[4] ..... F04F 5/48; F16K 3/00

[52] U.S. Cl. ..... 137/625.3; 417/187; 417/182; 251/294; 251/326

[58] Field of Search ..... 137/625.3; 417/168, 417/179, 180, 182, 187, 188, 189, 198, 185, 190; 138/44–46; 251/326

[56] References Cited

U.S. PATENT DOCUMENTS

| | | | |
|---|---|---|---|
| 210,941 | 12/1878 | Harrigan | 417/180 |
| 1,192,141 | 7/1916 | White | 251/326 |
| 3,103,941 | 9/1963 | Watters | 137/625.3 |
| 4,150,693 | 4/1979 | Genevey et al. | 137/625.3 |
| 4,595,344 | 6/1986 | Briley | 417/187 |
| 4,681,613 | 7/1987 | Porter | 251/326 |

FOREIGN PATENT DOCUMENTS

| | | | |
|---|---|---|---|
| 1231133 | 9/1902 | France | 251/326 |

*Primary Examiner*—William L. Freeh
*Assistant Examiner*—Robert N. Blackmon
*Attorney, Agent, or Firm*—K. Bach

[57] ABSTRACT

An oil ejector for conveying a quantity of oil under pressure to a region to be lubricated, the including a nozzle member (4,18) having an inlet end for receiving a supply of oil under pressure and an outlet end for ejecting oil supplied to the inlet end, the outlet end having an outlet passage (6,20) through which oil is ejected at a higher velocity and lower pressure than the oil entering the inlet end, the ejection pressure being a function of outlet passage (6,20) cross-sectional area, wherein the nozzle member (4,18) includes, at the outlet end, a fixed part (4) having at least one opening (6) and a movable part (18) mounted to the fixed part (4) for movement transverse to the ejection direction and having at least one opening (20) at least partly overlapping the opening (6) in the fixed part (4), with the region of overlap between the openings (6,20) defining the outlet passage (6,20), and the ejector further includes a remotely actuatable displacing mechanism (24,26) coupled to the movable part (18) for moving the movable part (18) relative to the fixed part (4) in order to vary the cross-sectional area of the outlet passage (6,20).

6 Claims, 1 Drawing Sheet

ADJUSTABLE OIL EJECTOR

BACKGROUND OF THE INVENTION

The present invention relates to oil ejectors of the type having a nozzle from which a high-velocity stream of motive oil is ejected to entrain pickup oil from a chamber surrounding the nozzle, to form a combined stream which is delivered at a defined pressure to a region to be lubricated.

Many types of large machines, such as turbine generators, include bearings which must be continuously lubricated. The effectiveness of the lubrication depends, inter alia, on the pressure with which the lubricating oil is being supplied to each bearing, there being an optimum oil pressure value for each bearing of a machine. The pressure with which oil is being supplied to each bearing can vary, during operation of the machine, due to a number of factors.

When ejectors of the type described above are used, a primary factor relied upon to set the bearing oil pressure is the cross-sectional area of the output opening or openings provided in the ejector nozzle. The value for this area is selected on the basis of estimated bearing flow and ejector discharge pressure and the known or estimated values for other factors that will influence the bearing oil pressure value.

If, after a machine has been assembled and placed into operation, it should be determined that the initial estimates were inaccurate, or if changes should occur in operating conditions which influence the bearing oil pressure, an adjustment must be made to enable the desired bearing oil pressure value to be achieved. For example, even if the nozzle outlet passage cross-sectional area had been correctly selected to initially provide the required bearing flow, it may be necessary to vary the bearing flow during the operating life of the machine due, for example, to increases in bearing clearances as the result of wear, or changes in system pressure losses due to changes in oil cooler operating mode.

It is current practice to make such an adjustment by physically varying the cross-sectional area of the nozzle outlet passages, either by remachining the nozzle or by replacing it. This, of course, requires shutdown of the entire machine, drainage of the reservoir supplying the pickup oil and disassembly of the ejector. It will be appreciated that machine shutdown, for any purpose, is undesirable and that the disassembly and reassembly required to effect a change in the cross-sectional area of the nozzle outlet openings is both costly and time consuming.

SUMMARY OF THE INVENTION

It is an object of the present invention to facilitate ejector nozzle output pressure adjustments.

Another object of the invention is to enable such adjustments to be made without requiring machine disassembly.

Another object of the invention is to permit such adjustments to be made while the machine in which the ejector is installed continues to operate.

Yet another object of the invention is to effect such adjustment in a manner which can be readily automated.

The above and other objects are achieved, according to the present invention, by an oil ejector for conveying a quantity of oil under pressure to a region to be lubricated, which ejector includes a nozzle member having an inlet end for receiving a supply of oil under pressure and an outlet end for ejecting oil supplied to the inlet end, the outlet end having an outlet passage through which oil is ejected at a higher velocity and lower pressure than the oil entering the inlet end, the ejection pressure being a function of outlet passage cross-sectional area, wherein the nozzle member is composed of, at the outlet end, a fixed part having at least one opening and a movable part mounted to the fixed part for movement transverse to the ejection direction and having at least one opening at least partly overlapping the opening in the fixed part, with the region of overlap between the openings defining the outlet passage, and the ejector further includes remotely actuatable displacing means coupled to the movable part for moving the movable part relative to the fixed part in order to vary the cross-sectional area of the outlet passage.

DESCRIPTION OF THE PREFERRED EMBODIMENTS

Figure 1:
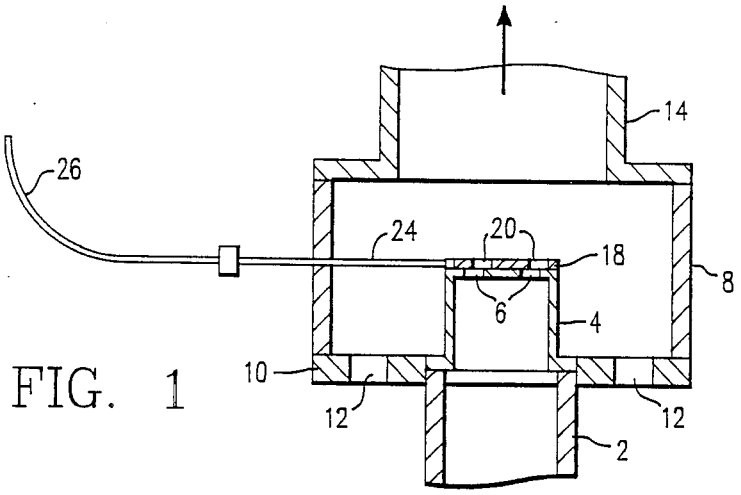
FIG. 1 is a cross-sectional view of the basic components of an oil ejector according to the present invention which can be employed for supplying bearing oil in a turbine generator.

FIG. 1 illustrates the basic components of an oil ejector containing a nozzle which is constructed in accordance with the present invention. The ejector is installed in an oil reservoir and includes a motive oil supply conduit 2 via which oil is supplied from a main oil pump. This oil is supplied to a nozzle 4 provided at its upper end with motive oil outlet openings 6. Nozzle 4 is installed in a pickup chamber delimited by a lateral wall 8 and a mounting disk 10 provided with openings 12 via which oil is drawn from the reservoir into the pickup chamber. The upper end of the pickup chamber is connected to a diffuser and throat conduit 14 through which a combined stream composed of motive oil exiting from nozzle 4 and pickup oil which has entered the pickup chamber via openings 12 is conveyed to a bearing to be lubricated.

When oil which has been delivered under pressure via conduit 2 passes through openings 6, its velocity increases and pressure decreases. As a result, the motive oil stream leaving openings 6 entrains oil contained in the pickup chamber to form the combined stream which then flows through conduit 14.

In combination with other system operating parameters, the pressure with which oil is supplied to a machine bearing varies as a function of ejector discharge pressure and this, in turn, is dependent on the effective cross-sectional area of openings 6. While, in theory, the outlet end of nozzle 4 can be provided with a single opening 6, the usual practice in the art is to provide a plurality of circular openings.

If the operating conditions within the machine should change, or initial calculations of other factors influencing bearing oil pressure should prove inaccurate, the desired bearing oil pressure could be established by altering the cross-sectional area of the passage defined by openings 6. When reference is made herein to the nozzle outlet passage, this is understood to refer to the total effective cross-sectional area of all of the openings provided at the outlet end of nozzle 4.

According to the present invention, the capability of varying the outlet passage cross-sectional area is established by providing nozzle 4, at its outlet end, with a part 18 in the form of a plate which is movable relative to the main part of nozzle 4 in a horizontal direction parallel to the plane of FIG. 1 and is provided with openings 20 which are aligned with openings 6. The arrangement and shape of the openings 20 provided in plate 18 are identical to those of openings 6.

In further accordance with the invention, openings 6 and 20 are elongated in a given direction transverse to the motive oil flow direction. The relative movement of part 18 is parallel to that given direction. This hole configuration allows for a larger range of cross-sectional area variation.

As is apparent from FIG. 1, horizontal movement of plate 18 will displace openings 20 relative to openings 6 in order to vary the effective cross-sectional area of the nozzle outlet passage.

For effecting such displacements of plate 18, that plate is coupled to a threaded shaft 24 which passes through an opening in lateral wall 8, which opening has a mating thread. Outside of the pickup chamber, shaft 24 is fixed to one end of a flexible shaft 26 whose other end extends to a location which is outside of the reservoir and which is accessible when the machine is assembled and is in operation.

Flexible shaft 26 is constructed to be flexible in its longitudinal direction but to impart rotational movement to shaft 24. When such rotational movement is imparted to shaft 24, this shaft is advanced horizontally by its threaded engagement with the opening in wall 8 and thus effects horizontal displacement of plate 18.

As will be explained in greater detail below, shaft 24 is coupled to plate 18 in such a manner that shaft 24 is free to rotate relative to plate 18 while transmitting horizontal longitudinal movements thereto.

Figure 2:
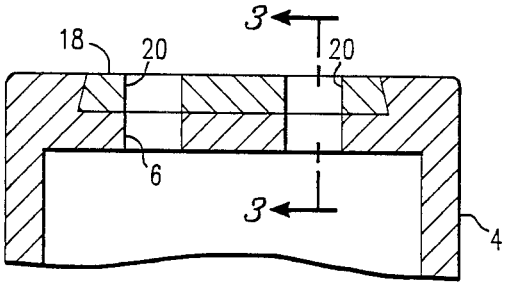
FIG. 2 is a cross-sectional detail view, to an enlarged scale, of the outlet portion of the nozzle shown in FIG. 1.
Figure 3:
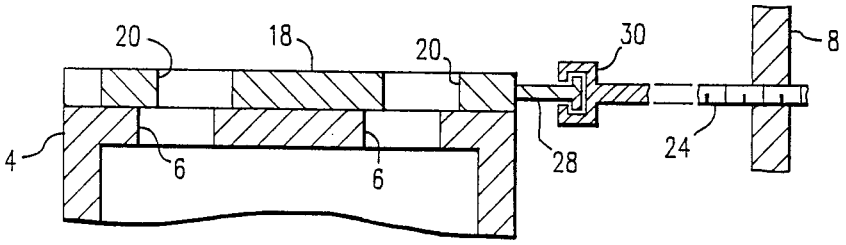
FIG. 3 is a cross-sectional view taken along the line 3—3 of FIG. 2.

The structural relation between plate 18 and the fixed part of nozzle 4 is shown in greater detail in FIGS. 2 and 3. FIG. 2 is a cross-sectional view in a plane perpendicular to the plane of FIG. 1, plate 18 being displaceable in a direction perpendicular to the plane of FIG. 2.

In order to maintain plate 18 in the desired position relative to the fixed part of nozzle 4, while permitting the desired displacement of plate 18, plate 18 and the fixed part of nozzle 4 are formed to provide a dovetail joint therebetween. With respect to the plane of FIG. 2, each opening 20 is aligned with a respective opening 6.

Referring to FIG. 3, which is in a plane parallel to the direction in which plate 18 is to be displaceable, it will be seen that the coupling between plate 18 and shaft 24 is provided by a pin 28 which is fixed to plate 18 and which has an enlarged head, and by a receptacle 30 which is fixed to the end of shaft 24 and which retains the enlarged head of pin 28 in order to create a coupling which transmits to plate 18 only the longitudinal displacements of shaft 24.

The coupling structure 28, 30 is shown only by way of example, it being appreciated that other couplings performing a similar function can be employed.

Figure 4:
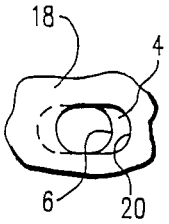
FIG. 4 is a detailed plan view of a portion of the outlet end of the nozzle shown in FIGS. 2 and 3.

As is apparent from FIGS. 3 and 4, each opening 20 at least partially overlaps a respective opening 6, with the overlapping regions of all openings defining the effective cross-sectional area of the nozzle outlet passage. Preferably, the dimensions of openings 6 and 20 are selected so that when the machine is initially placed in operation, the desired outlet opening cross-sectional area will be established when openings 20 are partially offset from openings 6. This allows the outlet cross-sectional area to be varied in either direction if machine operating conditions should require.

Reverting to FIG. 1, an adjustment in the outlet passage cross-sectional area can be effected by manual actuation of the external end of flexible shaft 26. However, according to the present invention, it would also be possible to couple the external end of flexible shaft 26 to a rotary actuator which is controlled by sensors responsive to oil pressure at the bearing, or at one of the bearings being supplied with lubricating oil from the ejector.

What is claimed:

1. An oil ejector for conveying a quantity of oil under pressure to a region to be lubricated, said ejector comprising a nozzle member having an inlet end for receiving a supply of oil under pressure and an outlet end for ejecting oil supplied to the inlet end, said outlet end having an outlet passage through which oil is ejected at a higher velocity and lower pressure than the oil entering the inlet end, the ejection pressure being a function of outlet passage cross-sectional area, wherein said nozzle member comprises, at said outlet end, a fixed part having a plurality of openings and a movable part mounted to said fixed part for movement in one direction relative to said fixed part transverse to the ejection direction and having a plurality of openings each at least partly overlapping a respective opening in said fixed part, with the regions of overlap between said pluralities of openings defining said outlet passage, said openings in said fixed part and said movable part being elongated in the direction of relative movement between said parts, said openings providing partial and maximum flow, said partial flow being at one point of the relative movement between the fixed and moveable plates at which said openings provide a generally circular cross-section and at said maximum flow said openings providing an elliptical cross-section when the fixed and moveable plates assume a second position, and said ejector further comprises remotely actuatable displacing means coupled to said movable part for moving said movable part relative to said fixed part in order to vary the cross-sectional area of said outlet passage.

2. An arrangement as defined in claim 1 wherein said oil ejector further comprises a wall member which surrounds said nozzle member, is stationary relative to said nozzle member, and is provided with a threaded opening, and said remotely actuatable displacing means comprise a threaded shaft which passes through, and is in threaded engagement with, said opening in said wall member, and means coupling said shaft to said movable part in a manner which permits said shaft to rotate freely relative to said movable part.

3. An arrangement as defined in claim 2 wherein said threaded shaft has an exterior end located outside the region enclosed by said wall member, and said remotely actuatable displacing means further comprise a flexible rotation transmitting shaft coupled to said external end of said threaded shaft.

4. An arrangement as defined in claim 3 wherein said flexible shaft extends to a region which is accessible when said oil ejector is in operation.

5. An arrangement as defined in claim 4 wherein said fixed part and said movable part are formed so as to be coupled together by a dovetail joint which permits relative movement between said parts in one direction transverse to the direction of oil flow through said outlet passage.

6. An arrangement as defined in claim 1 wherein said fixed part and said movable part are formed so as to be coupled together by a dovetail joint which permits relative movement between said parts in one direction transverse to the direction of oil flow through said outlet passage.

* * * * *